US007592048B2

(12) United States Patent
Li et al.

(10) Patent No.: US 7,592,048 B2
(45) Date of Patent: Sep. 22, 2009

(54) PHOTOCATALYTIC SUBSTRATE AND PROCESS FOR PRODUCING THE SAME

(75) Inventors: Shulong Li, Spartanburg, SC (US); Richard Arthur Mayernik, Mauldin, SC (US)

(73) Assignee: Milliken & Company, Spartanburg, SC (US)

( * ) Notice: Subject to any disclaimer, the term of this patent is extended or adjusted under 35 U.S.C. 154(b) by 0 days.

(21) Appl. No.: 11/983,274

(22) Filed: Nov. 8, 2007

(65) Prior Publication Data

US 2008/0063803 A1 Mar. 13, 2008

Related U.S. Application Data

(62) Division of application No. 11/314,113, filed on Dec. 21, 2005.

(51) Int. Cl.
*B05D 3/02* (2006.01)

(52) U.S. Cl. ..... 427/389.9; 427/391; 427/392; 427/393; 427/393.4; 427/394; 427/395; 427/396

(58) Field of Classification Search ..... None
See application file for complete search history.

(56) References Cited

U.S. PATENT DOCUMENTS

| | | | |
|---|---|---|---|
| 4,904,709 | A | 2/1990 | Hermele |
| 5,049,159 | A | 9/1991 | Yamaji et al. |
| 5,449,443 | A | 9/1995 | Jacoby et al. |
| 5,547,823 | A | 8/1996 | Murasawa et al. |
| 5,616,532 | A | 4/1997 | Heller et al. |
| 5,670,247 | A | 9/1997 | Takaoka et al. |
| 5,690,922 | A | 11/1997 | Mouri et al. |
| 5,755,867 | A | 5/1998 | Chikuni et al. |
| 5,766,277 | A | 6/1998 | De Voe et al. |
| 5,872,072 | A | 2/1999 | Mouri et al. |
| 5,981,425 | A | 11/1999 | Taoda et al. |
| 6,037,289 | A | 3/2000 | Chopin et al. |
| 6,113,861 | A | 9/2000 | Ogata |
| 6,180,548 | B1 | 1/2001 | Taoda et al. |
| 6,187,438 | B1 | 2/2001 | Chopin et al. |
| 6,191,062 | B1 | 2/2001 | Hayakawa et al. |

(Continued)

FOREIGN PATENT DOCUMENTS

| | | | |
|---|---|---|---|
| JP | 63-295711 | A | 12/1988 |

(Continued)

OTHER PUBLICATIONS

Partial machine translation of JP 11-262626, Sep. 1999.*

(Continued)

*Primary Examiner*—Erma Cameron
(74) *Attorney, Agent, or Firm*—Cheryl J. Brickey

(57) ABSTRACT

A photocatalytic substrate comprises a textile support and a finish on the surface thereof. The finish on the surface of the textile support comprises a particulate photocatalytic material and a binder. A process for producing a photocatalytic substrate comprises the steps of providing a textile support having at least one surface, providing a coating composition, applying the coating composition to at least a portion of the surface of the textile support, and drying the surface of the textile support to which the coating composition was applied to produce a photocatalytic substrate.

8 Claims, 6 Drawing Sheets

U.S. PATENT DOCUMENTS

| | | | | |
|---|---|---|---|---|
| 6,228,480 | B1 | 5/2001 | Kimura et al. | |
| 6,245,200 | B1 | 6/2001 | Wilcoxon | |
| 6,346,253 | B2 | 2/2002 | Takaoka et al. | |
| 6,383,980 | B1 | 5/2002 | Hagihara et al. | |
| 6,407,033 | B1 | 6/2002 | Kimura et al. | |
| 6,413,581 | B1 | 7/2002 | Greenberg et al. | |
| 6,540,792 | B1 | 4/2003 | Ishii et al. | |
| 6,592,858 | B1 | 7/2003 | Honda et al. | |
| 6,607,702 | B1 | 8/2003 | Kang et al. | |
| 6,818,153 | B2 | 11/2004 | Burnell-Jones | |
| 6,887,816 | B2 | 5/2005 | Tanaka et al. | |
| 2002/0028288 | A1* | 3/2002 | Rohrbaugh et al. | 427/180 |
| 2003/0100445 | A1* | 5/2003 | Ueda et al. | 502/182 |
| 2003/0150820 | A1* | 8/2003 | Dussaud et al. | 210/748 |
| 2004/0224145 | A1 | 11/2004 | Weir et al. | |
| 2004/0229540 | A1 | 11/2004 | Akiba et al. | |
| 2004/0245496 | A1* | 12/2004 | Taoda | 252/186.1 |
| 2005/0227008 | A1* | 10/2005 | Okada et al. | 427/372.2 |

FOREIGN PATENT DOCUMENTS

| | | | |
|---|---|---|---|
| JP | 09-192078 | A | 7/1997 |
| JP | 09-296364 | A | 11/1997 |
| JP | 10-71322 | A | 3/1998 |
| JP | 11-100771 | A | 4/1999 |
| JP | 11-262626 | A | 9/1999 |
| JP | 2000-110063 | A | 4/2000 |
| JP | 2000-119971 | A | 4/2000 |
| JP | 2001-245778 | A | 9/2001 |

OTHER PUBLICATIONS

Abstracts and partial machine translation of JP 2005-194652, Jul. 1995.*

* cited by examiner

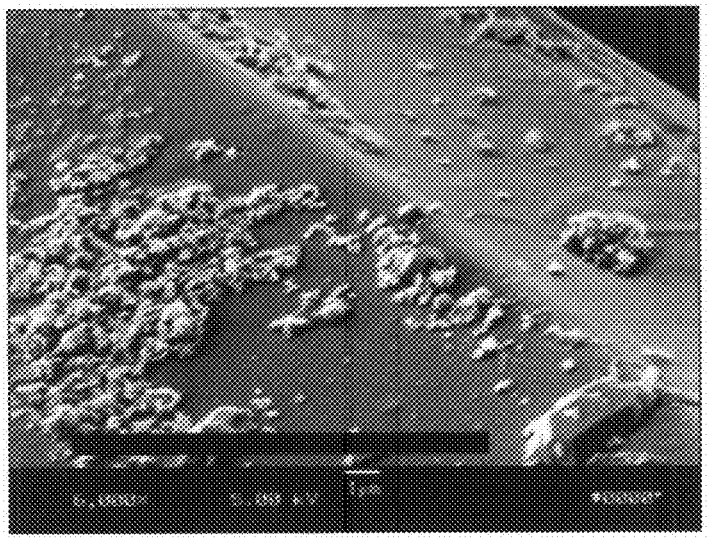
FIG. –1–
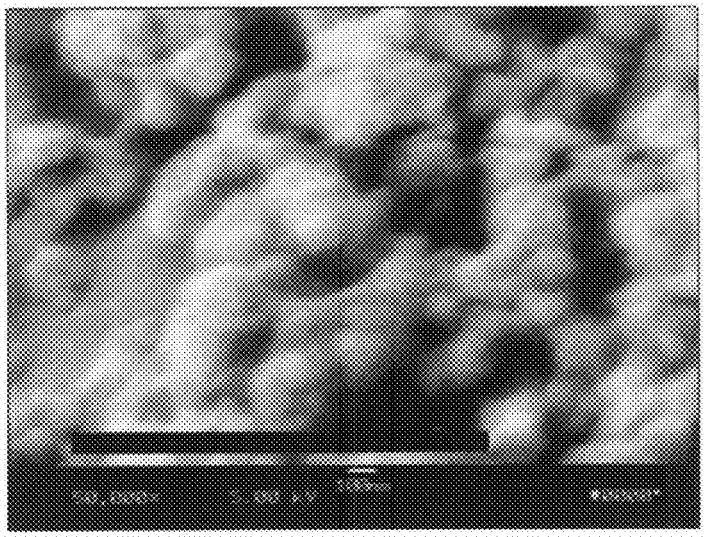
FIG. –1A–

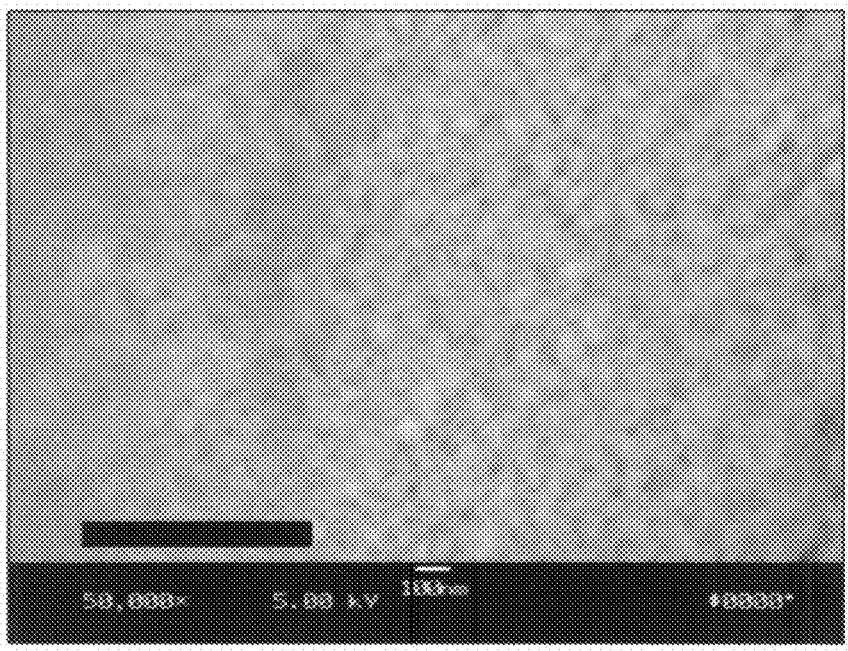
FIG. —2B—

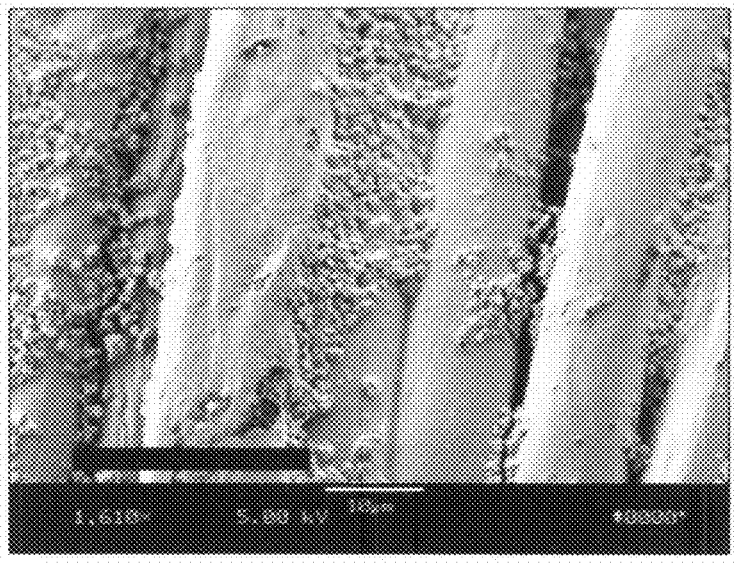
FIG. —4—
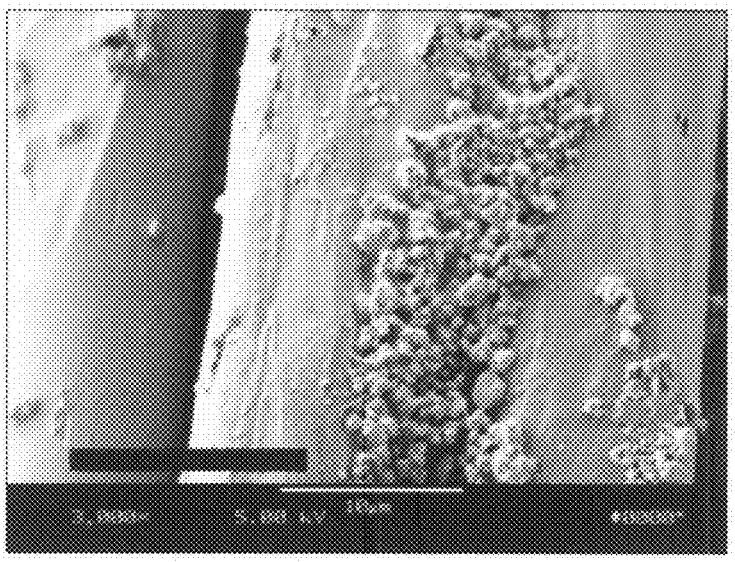
FIG. —4A—

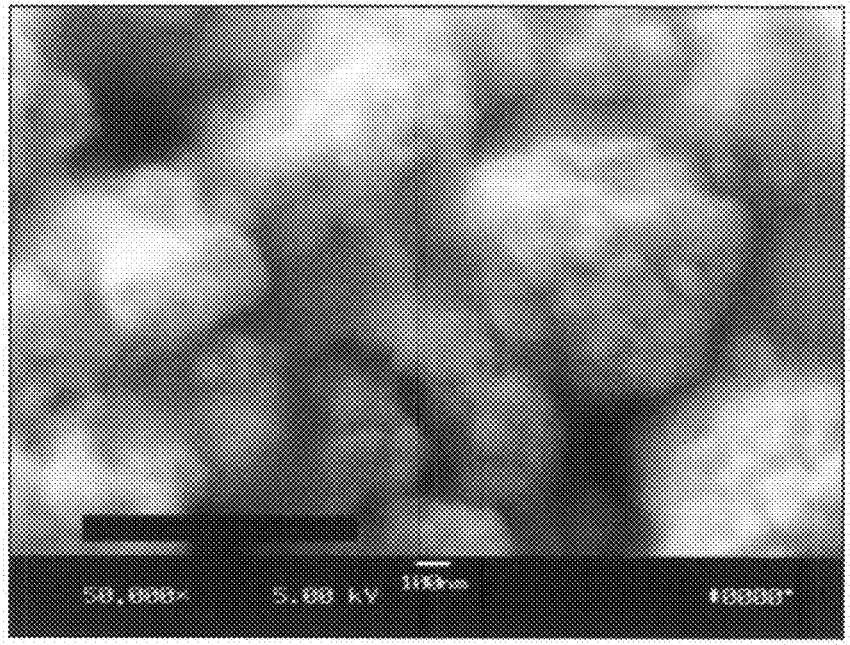
FIG. —4B—

PHOTOCATALYTIC SUBSTRATE AND PROCESS FOR PRODUCING THE SAME

CROSS REFERENCE TO RELATED APPLICATIONS

The present application is a divisional of co-pending application Ser. No. 11/314,113, filed Dec. 21, 2005.

FIELD OF THE INVENTION

The invention relates to photocatalytic substrates and processes for producing the same.

BRIEF SUMMARY OF THE INVENTION

The invention provides a photocatalytic substrate comprising a textile support and a finish on the surface thereof. The finish on the surface of the textile support comprises a particulate photocatalytic material and a binder.

The invention also provides a process for producing a photocatalytic substrate. The process comprises the steps of providing a textile support having at least one surface, providing a coating composition, applying the coating composition to at least a portion of the surface of the textile support, and drying the surface of the textile support to which the coating composition was applied to produce a photocatalytic substrate.

BRIEF DESCRIPTION OF THE DRAWINGS

FIG. 1 is a scanning electron micrograph (6,000 times magnification) of a portion of the surface of Sample 3A.

FIG. 1A is a scanning electron micrograph (50,000 times magnification) of a portion of the surface of Sample 3A.

FIG. 2B is a scanning electron micrograph (50,000 times magnification) of a portion of the surface of Sample 3B.

FIG. 4 is a scanning electron micrograph (1,610 times magnification) of a portion of the surface of Sample 3D.

FIG. 4A is a scanning electron micrograph (3,000 times magnification) of a portion of the surface of Sample 3D.

FIG. 4B is a scanning electron micrograph (50,000 times magnification) of a portion of the surface of Sample 3D.

DETAILED DESCRIPTION OF THE INVENTION

Figure 2:
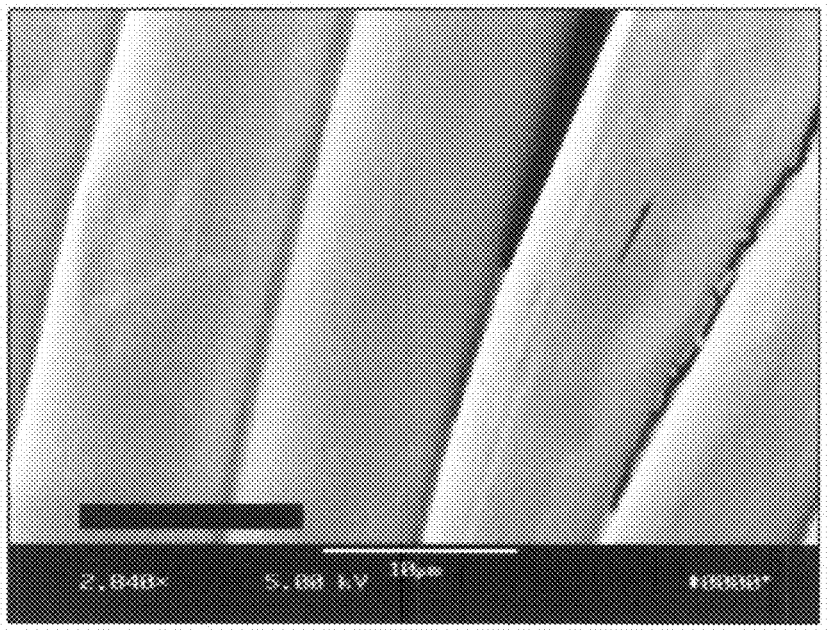
FIG. 2 is a scanning electron micrograph (2,840 times magnification) of a portion of the surface of Sample 3B.
Figure 2A:
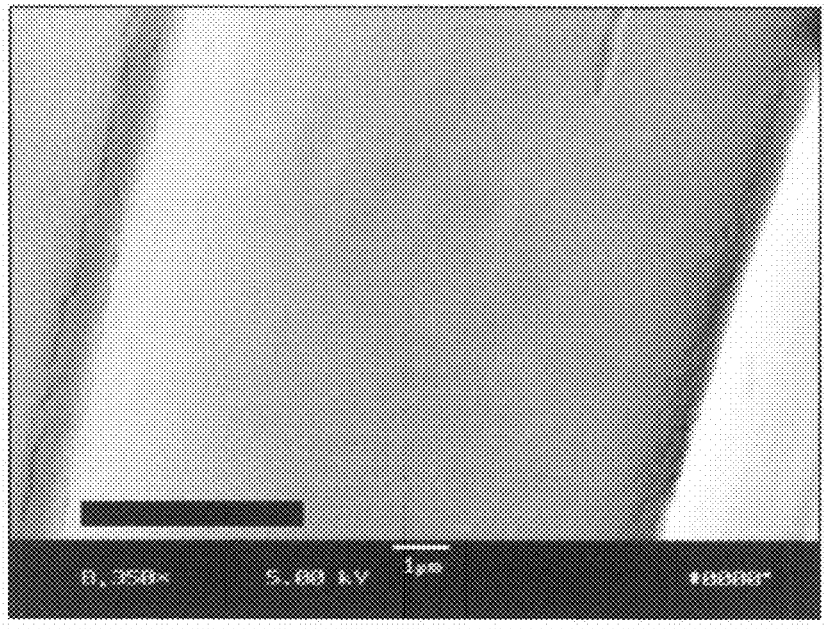
FIG. 2A is a scanning electron micrograph (8,350 times magnification) of a portion of the surface of Sample 3B.

As noted above, the invention provides a photocatalytic substrate comprising a textile support and a finish on the surface thereof. The textile material utilized as the support can be any suitable textile material. For example, the textile support can be provided in a knit, woven, or nonwoven construction and can comprise yarns or fibers made from natural fibers, synthetic fibers, regenerated fibers, and blends of any two or more of the three. Natural fibers suitable for use in the textile support include, but are not limited to, cellulose fibers (e.g., cotton), wool, and silk. Synthetic fibers suitable for use in the textile support include, but are not limited to, polyesters, polyamides (e.g., aliphatic and aromatic polyamides), polyolefins (e.g., polyethylene and polypropylene), polylactic acid, polyacrylics, polyurethanes, polyketones, phenylformaldehyde resins, and combinations thereof. In certain possibly preferred embodiments, the textile support comprises polyester-containing yarns (i.e., yarns comprising, consisting essentially of, or consisting of polyester fibers or filaments) or polyester fibers, and the yarns or fibers are provided in a woven, nonwoven, or knit construction.

The finish on the surface of the textile support comprises a particulate photocatalytic material and a binder. As utilized herein to refer to the photocatalytic material, the term "particulate" refers to a photocatalytic material comprising a collection of minute separate particles. In particular, the term "particulate photocatalytic material" refers to a photocatalytic material comprising a plurality of primary particles. For certain photocatalytic materials, these primary particles can be fused together to form aggregates, which is a term used to refer to a collection of primary particles that are physically bound to each other and can only be reduced to its constituent primary particles through the application of an appreciable mechanical force. The individual aggregates of primary particles can be further associated to form agglomerates. Alternatively, the individual primary particles of the particular photocatalytic material can also be associated to form agglomerates.

The photocatalytic material utilized in the substrate can be any suitable photocatalytic material. As utilized herein, the term "photocatalytic material" generally refers to a material that is capable of catalyzing a chemical reaction upon exposure of the material to light (e.g., ultraviolet and/or visible light). For example, as utilized herein, the term "photocatalytic material" refers to a material that, upon exposure to light (e.g., ultraviolet and/or visible light), is capable of catalyzing the redox reaction(s) involved in the decomposition or oxidation of organic materials, such as organic odor-causing substances, volatile organic compounds, and organic-based staining agents. Photocatalytic materials suitable for use in the substrate include, but are not limited, titanium dioxide (e.g., anatase titanium dioxide), doped titanium dioxide, molybdenum sulfide, zinc oxide, and combinations thereof. The term "anatase titanium dioxide" is used to refer to the anatase crystalline form of titanium dioxide, as well as titanium dioxide which contains a significant portion (e.g., greater than about 50%, or greater than about 60%, or greater than about 70%) of the anatase crystalline form. As utilized herein, the term "doped titanium dioxide" refers to titanium dioxide that has been doped with other elements (e.g., carbon, nitrogen, or other elements or metals) or inorganic oxides in order to lower the band gap between the valence state electrons and the excited, conducting band electron state (i.e., the state(s) to which the electrons in the titanium dioxide are excited upon exposure to visible or ultraviolet light). This lowering of the band gap of the photocatalytic material reduces the oxidative potential of the photocatalytic material, which may help to reduce potential damage or degradation of the substrate by the photocatalytic material. In certain possibly preferred embodiments, the particulate photocatalytic material comprises fumed, anatase titanium dioxide.

Photocatalysts, such as anatase titanium dioxide, are known to decompose organic materials, such as organic dyes, organic polymers (e.g., resin binders), and many organic polymer fibers. Thus, it has generally been difficult to provide a photocatalytic coating or finish on an organic substrate without sacrificing the long-term light stability or mechanical integrity of the organic substrate. Notwithstanding these difficulties, it is believed that, in accordance with the present invention, a photocatalytically active coating or finish can be provided on a substrate (e.g., a substrate formed from organic materials) using a particulate photocatalytic material and a binder (e.g., an organic resin binder), without adversely affecting the light stability of the color or the mechanical properties of the substrate.

The photocatalytic material can be present in the finish in any suitable amount. Typically, the photocatalytic material is present in the finish in an amount of about 0.05 wt. % or more, based on the total weight of the substrate. In certain possibly preferred embodiments, the photocatalytic material can be present in the finish in an amount of about 0.1 wt. % or more, about 0.2 wt. % or more, about 0.3 wt. % or more, about 0.4 wt. % or more, or about 0.5 wt. % or more, based on the total weight of the substrate. Typically, the photocatalytic material is present in the finish in an amount of about 2 wt. % or less, based on the total weight of the substrate. In certain possibly preferred embodiments, the photocatalytic material can be present in the finish in an amount of about 1.75 wt. % or less, about 1.5 wt. % or less, about 1.25 wt. % or less, or about 1 wt. % or less, based on the total weight of the substrate. In certain possibly preferred embodiments, the photocatalytic material is present in the finish in an amount of about 0.05 to about 2 wt. % or about 0.5 to about 1 wt. %, based on the total weight of the substrate.

As noted above, the finish on the textile support comprises a binder in addition to the photocatalytic material. The binder in the finish can be any suitable binder, including organic and inorganic binders. In certain possibly preferred embodiments, the binder is an organic binder in which the polymer backbone of the binder comprises about 50% or less (e.g., about 40% or less, about 30% or less, or about 20% or less), by number, of Si—O and/or C—F bonds. Suitable organic binders include, but are not limited to, latex binders, polyacrylate binders, vinyl ester binders, polyurethane binders, polyethylene-vinyl acetate binders, polyolefin binders, polyester binders, polyamide binders, polyether binders, poly(styrene-co-butadiene) binders, polyisoprene binders, polychloroprene binders, and combinations thereof. In certain possibly preferred embodiments, the binder is a latex binder.

Specific examples of binders which are believed to be suitable for use in the photocatalytic substrate and are believed to be commercially available include, but are not limited to, the following: a polyacrylic latex including perfluorocarbon-modified monomers sold under the name UNIDYNE TG-5010 by Daikin Industries, Ltd.; polyacrylic latex resins sold under the names RHOPLEX HA-16, RHOPLEX E-32NP, and RHOPLEX NW-1402 by Rohm and Haas Company; polyacrylic latex resins sold under the names HYCAR 2671 and HYSTRETCH V-43 by Noveon, Inc.; an ethylene-vinyl acetate copolymer latex sold under the name AIRFLEX TL-51 by Air Products and Chemicals, Inc.; a polyurethane emulsion sold under the name SANCURE 2026 by Noveon, Inc.; and a copolymer of methyl methacrylate and vinylidene fluoride which was believed to have been sold under the name FLUOROSHIELD 2000W by Advanced Polymer, Inc.

The finish on the textile support can comprise any suitable amount of the binder. Typically, the binder is present in the finish in an amount sufficient to provide a ratio, by weight, of photocatalytic material to binder solids of about 1:0.1 or more. In certain possibly preferred embodiments, the binder is present in the finish in an amount sufficient to provide a ratio, by weight, of photocatalytic material to binder solids of about 1:0.2 or more, or about 1:0.5 or more. The binder typically is present in the finish in an amount sufficient to provide a ratio, by weight, of photocatalytic material to binder solids of about 1:5 or less. In certain possibly preferred embodiments, the binder is present in the finish in an amount sufficient to provide a ratio, by weight, of photocatalytic material to binder solids of about 1:2 or less, or about 1:1 or less. In certain possibly preferred embodiments, the binder is present in the finish in an amount sufficient to provide a ratio, by weight, of photocatalytic material to binder solids of about 1:0.1 to about 1:5, or about 1:0.2 to about 1:2.

As noted above, the photocatalytic material can, in certain possibly preferred embodiments, comprise a plurality of primary particles which, in turn, can be physically associated or fused to form aggregates. The primary particles and/or aggregates of primary particles can, as noted above, become further associated within the finish to form agglomerates. Due to the surface structure resulting from the physical association of these primary particles and/or aggregates, the agglomerates typically have a porous outer surface. While not wishing to be bound to any particular theory, it is believed that the porous outer surface of these agglomerates provides a significant surface area that is available to take part in the photocatalysis of the redox reaction that leads to the decomposition or oxidation of, for example, organic odor-causing substances, volatile organic compounds, and organic-based staining agents. Furthermore, it is believed that the structure of these agglomerates provides a suitable surface for anchoring the photocatalytic material to the textile support, thereby providing a durable finish on the textile support.

The agglomerates, when present in the finish of certain embodiments of the photocatalytic substrate, can have any suitable size or diameter. In certain possibly preferred embodiments, the agglomerates have a diameter of about 0.2 to about 14 microns or about 1 to about 6 microns.

The finish on the textile support can also include other suitable agents, such as an antimicrobial compound or additive. Suitable antimicrobial compounds or additives include, but are not limited to, inorganic antimicrobial additives such as silver zeolites, silver particles (e.g., nanosilver particles), silver zirconium phosphates, and combinations thereof. A specific example of an antimicrobial additive which is believed to be suitable for use in the photocatalytic substrate is ALPHASAN® RC 5000 antimicrobial additive from Milliken Chemical. When present in the finish, the additional additives or agents can be present in any suitable amount. For example, when the finish comprises an antimicrobial additive, the additive can be present in the finish in an amount of about 0.5 wt. %, based on the total weight of the substrate.

The photocatalytic substrate can be produced by any suitable method; however, the invention also provides a process for producing a photocatalytic substrate. The process comprises the steps of providing a textile support having at least one surface, providing a coating composition, applying the coating composition to at least a portion of the surface of the textile support, and drying the surface of the textile support to which the coating composition was applied to produce a photocatalytic substrate.

The textile support utilized in the above-described process can be any suitable textile material. Suitable textile materials include, but are not limited to, those textile materials described above in connection with the photocatalytic substrate of the invention.

The coating composition utilized in the above-described method comprises a particulate photocatalytic material and a binder dispersed or suspended in a suitable liquid medium. The photocatalytic material and the binder utilized in the method can be any suitable photocatalytic material and binder, including those photocatalytic materials and binders described above in connection with the photocatalytic substrate of the invention. The liquid medium in which photocatalytic material and binder are dispersed or suspended can be any suitable liquid medium. In certain possibly preferred embodiments, the liquid medium is an aqueous medium.

The coating composition utilized in the above-described method can be prepared by any suitable method. Typically, the coating composition is prepared by first providing a suitable liquid medium, then dispersing or suspending a dry, particulate photocatalytic material (e.g., a photocatalytic material in the form of a powder) in the liquid medium, and adding the binder to the liquid medium. Preferably, the particulate photocatalytic material is dispersed or suspended in the liquid medium without excessive, grinding, milling, or ultra-high shear mixing. While not wishing to be bound to any particular theory, it is believed that dispersing or suspending the particulate photocatalytic material in this manner allows the individual primary particles and/or aggregates present in the photocatalytic material to form agglomerates, which agglomerates are then deposited onto the textile support in subsequent steps of the method.

The coating composition can comprise any suitable amounts of the particulate photocatalytic material and binder. In order to ensure sufficient deposition of the photocatalytic material onto the textile support, the coating composition typically comprises about 0.2 wt. % or more, based on the total weight of the coating composition, of the particulate photocatalytic material. The coating composition typically comprises about 1 wt. % or less, based on the total weight of the coating composition, of the particulate photocatalytic material. In certain possibly preferred embodiments, the coating composition comprises about 0.2 to about 1 wt. %, based on the total weight of the coating composition, of the photocatalytic material. Typically, the binder is present in the coating composition in an amount sufficient to provide a ratio, by weight, of photocatalytic material to binder solids of about 1:0.1 or more. In certain possibly preferred embodiments, the binder is present in the coating composition in an amount sufficient to provide a ratio, by weight, of photocatalytic material to binder solids of about 1:0.2 or more, or about 1:0.5 or more. The binder typically is present in the coating composition in an amount sufficient to provide a ratio, by weight, of photocatalytic material to binder solids of about 1:5 or less. In certain possibly preferred embodiments, the binder is present in the coating composition in an amount sufficient to provide a ratio, by weight, of photocatalytic material to binder solids of about 1:2 or less, or about 1:1 or less. In certain possibly preferred embodiments, the binder is present in the coating composition in an amount sufficient to provide a ratio, by weight, of photocatalytic material to binder solids of about 1:0.1 to about 1:5, or about 1:0.2 to about 1:2.

In order to facilitate the formation of a stable dispersion or suspension of the photocatalytic material, the coating composition can, in certain possibly preferred embodiments, comprise a dispersant. The dispersant can be any suitable dispersant, provided it is compatible with both the photocatalytic material and the binder in the coating composition. Suitable dispersant include, but are not limited to, phosphate esters, ammonia, ammonium hydroxide, and combinations thereof. As utilized herein, the term "phosphate ester" is utilized to refer to the monoesters, diesters, and triesters represented by the following general structures:

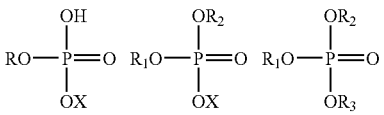

In these general structures, R, $R_1$, $R_2$, and $R_3$ preferably are acyl-containing organic radicals, and X preferably is an ammonium, a proton, or a monovalent metal ion. In certain possibly preferred embodiments, R, $R_1$, $R_2$, and $R_3$ are an ethoxylated phenol, alcohol, or carboxylic acid. Phosphate esters believed to be suitable for use in the coating composition and believed to be commercially available include, but are not limited to, the phosphate esters sold under the names RHODOFAC and SOPROPHOR by Rhodia, Inc. The dispersant can be added to the liquid medium of the coating composition at any suitable point in the preparation of the coating composition. For example, the dispersant can be added to the liquid medium prior to the addition of the particulate photocatalytic material and the binder, or after the addition of the particulate photocatalytic material and before the addition of the binder.

When prepared in accordance with the foregoing procedure, the particulate photocatalytic material forms agglomerates in the coating composition. The size of the agglomerates may vary depend upon, for example, the particular photocatalyst used, the structure of the photocatalyst, the binder present in the coating composition, and any dispersant added to the coating composition. In certain embodiments, such as when a fumed, anatase-rich titanium dioxide is used as the particulate photocatalytic material, the coating composition is believed to contain a small portion of agglomerates having a diameter in the range of about 40 to about 120 microns and a larger portion of agglomerates having a diameter in the range of about 0.2 to about 14 microns. Within the larger portion of agglomerates (i.e., those agglomerates having a diameter of about 0.2 to about 14 microns), a majority (e.g., about 50% or more) of the agglomerates are believed to have a diameter of about 1 to about 6 microns. Those agglomerates having a diameter greater than about 40 microns are believed to be less stable than the smaller agglomerates, showing a tendency to settle out with time in a dilute, low viscosity coating composition. The larger agglomerates may, however, be suspended in a relatively stable manner in a viscous coating composition produced using, for example, a thickening agent. If a significant amount of agglomerates having a diameter greater than about 40 microns are present in the coating composition, these larger agglomerates can be removed, for example, by passing the coating composition through a suitable filter media, or the diameter of the agglomerates can be reduced by ultrasonication, mechanical shear mixing, or gentle grinding of the coating composition. Those agglomerates having a diameter of about 0.2 to about 14 microns are believed to be more stable than the larger agglomerates and are, therefore, more desirable than the larger agglomerates.

The coating composition can be applied to the surface of the textile support using any suitable method. For example, the coating composition can be printed or sprayed onto the surface of the textile support. Alternatively, the textile support can be immersed in the coating composition and, in certain embodiments, passed through a pair of nip rollers to remove any excess liquid medium from the textile support.

The coated textile support can be dried by any suitable method. For example, the textile support can be dried by exposing the coated textile support to an elevated temperature, for example, in an oven for a time sufficient to dry the support and produce the photocatalytic substrate.

The photocatalytic substrate of the invention and the substrate produced by the process of the invention may be useful in a variety of applications. For example, it is believed that the photocatalytic substrate may be particularly useful as upholstery in an automobile interior. Indeed, it is believed that automotive upholstery incorporating the photocatalytic substrate may be particularly effective at degrading or oxidizing organic-based odors, such as cigarette smoke. While not wishing to be bound to any particular theory, it is believed that the significant surface area of the upholstery and the significant exposure of the upholstery to ultraviolet and visible light may provide an ideal environment for the rapid degradation or oxidation of organic odor-causing agents.

The following examples further illustrate the invention but, of course, should not be construed as in any way limiting its scope.

EXAMPLE 1

This example demonstrates the preparation of a photocatalytic substrate according to the invention and the photocatalytic properties of the same. A coating composition was prepared by dispersing approximately 0.6 grams of a fumed, anatase-rich titanium dioxide (AEROXIDE P25 from Degussa) was dispersed in approximately 98 grams of deionized water using gentle stirring. Next, approximately 0.1 grams of a phosphate ester surfactant (RHODOFAC RS-610 from Rhodia, Inc.) were added to the dispersion, and approximately 0.2 grams of ammonium hydroxide was added to the dispersion to raise the pH to approximately 8. Approximately 0.5 grams of a methyl methacrylate and vinylidene fluoride copolymer binder (FLUOROSHIELD 2000W from Advanced Polymer, Inc.) was then added to the dispersion to yield a coating composition.

A swatch of white, plain woven, 100% spun yarn, polyester fabric was then immersed in the coating composition and passed through a pair of nip rollers set at a pressure of approximately 280 kPa (40 psi). The treated fabric swatch was then placed in a convection oven and dried at a temperature of approximately 180° C., (350° F.) for approximately 3 minutes. The resulting photocatalytic substrate had a finish on the surface thereof, and the finish contained approximately 5 grams of photocatalyst per square meter of fabric and a ratio, by weight, of photocatalyst to binder of approximately 2:1.

In order to qualitatively measure the photocatalytic properties of the substrate, a swatch of the substrate measuring approximately 10 cm (4 inches) by approximately 8 cm (3 inches) was placed into a 3.8 liter (1 gallon) clear, glass jar which had been fitted with an injection port. Approximately 30 ml of smoke was then drawn from a lit cigarette using a syringe, and the smoke was injected into the jar via the injection port. The jar was then placed between two 20 watt parallel black light tubes to expose the photocatalytic substrate to ultraviolet radiation. After the desired time of exposure, the odor of the air inside the jar and the odor of the substrate in the jar were evaluated by human judges, and the results were recorded. After two hours exposure, the substrate and the air inside the jar exhibited a significant reduction in cigarette odor. After five hours of exposure, the cigarette odor was not noticeable. A similar, untreated fabric which was tested under the same conditions still exhibited a strong cigarette odor.

The photocatalytic activity of the substrate was also quantitatively measured in the following manner. A swatch of the photocatalytic substrate measuring approximately 12 cm (4.75 inches) by approximately 6.4 cm (2.5 inches) was placed in a 64 ml clear glass vial fitted with a rubber septum. Approximately two milliliters of vapor-saturated acetaldehyde were then injected into the vial, and the vial was placed between two 20 watt black light tubes separated by a distance of approximately 2.5 cm (1 inch). One milliliter gas samples were then periodically drawn from the vial for GC analysis to determine the relative acetaldehyde concentration. Using these concentration measurements, the rate constant for the decomposition of the acetaldehyde according the following reaction can be determined:

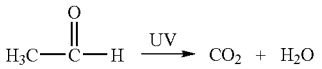

Assuming that the decomposition reaction follows first order kinetics, the rate constant for the reaction can be determined using the following equation:

$$\frac{d[M]}{dt} = -k[M]$$

In the equation, [M] represents the concentration of acetaldehyde in the vial after a specified time of UV irradiation, t represents the time (in minutes) of UV irradiation, and k is the rate constant of the decomposition reaction. Integrating the foregoing equation over time from 0 to t yields the following equation:

$$\log\left(\frac{[M]}{[M]_0}\right) = -kt$$

In this equation, [M], t, and k are the same as set forth for the preceding equation, and $[M]_0$ represents the initial concentration of acetaldehyde in the vial before UV irradiation. By plotting the value of $\log([M]/[M]_0)$ versus time (t), the rate constant of the decomposition reaction can be determined from the slope of the plotted line.

In accordance with the foregoing procedure, one milliliter gas samples were withdrawn from the vial containing the substrate and acetaldehyde before UV irradiation, and after 30, 60, 120, and 180 minutes of UV irradiation. The values calculated for $([M]/[M]_0)$ and $\log([M]/[M]_0)$ at the specified times are set forth in Table 1 below.

TABLE 1

Values for $([M]/[M]_0)$ and $\log([M]/[M]_0)$ at specified times.

| | Time (min) | | | | |
|---|---|---|---|---|---|
| | 0 | 30 | 60 | 120 | 180 |
| $([M]/[M]_0)$ | 1.00 | 0.83 | 0.66 | 0.46 | 0.22 |
| $\log([M]/[M]_0)$ | 0 | −0.081 | −0.18 | −0.34 | −0.66 |

After plotting the values of $\log([M]/[M]_0)$ versus time (t), the rate constant of the decomposition reaction in the presence of the photocatalytic substrate was determined to be approximately 0.0035 $min^{-1}$.

EXAMPLE 2

This example demonstrates the preparation of a photocatalytic substrate according to the invention and the photocatalytic properties of the same. A photocatalytic substrate was prepared in accordance with the general procedure set forth in Example 1. The coating composition used to produce the substrate was substantially identical to that utilized in Example 1, with the exception that the binder used to in the composition was 0.5 grams of a polyacrylate latex binder (RHOPLEX E-32NP from Rohm and Haas Company).

The photocatalytic activity of the resulting substrate was then qualitatively and quantitatively measured in accordance with the procedures set forth in Example 1. After two hours of UV exposure, the human judges were unable to detect cigarette odor from the air in the jar of the substrate. Also, the rate constant of the decomposition reaction of acetaldehyde in the presence of the photocatalytic substrate was determined to be approximately 0.0035 $min^{-1}$.

EXAMPLE 3

This example demonstrates the preparation of several photocatalytic substrates according to the invention and the photocatalytic properties of the same. Four substrates (Samples 3A-3D) were prepared in accordance with the general procedure set forth in Example 1 using 1 wt. % of four different photocatalysts and 0.5 wt. % of a latex binder (RHOPLEX HA-16 from Rohm and Haas Company). Sample 3A was produced using a fumed, anatase-rich titanium dioxide powder (AEROXIDE P25 from Degussa) as the photocatalyst. Sample 3B was produced using an anatase-rich titanium dioxide sol (TPX-85 from Kon Corporation). Sample 3C was produced using another anatase-rich titanium dioxide sol (STS-01 from Ishihara Corporation USA). Sample 3D was produced using an anatase-rich titanium dioxide powder (ANX Type A from Kemira Corp.).

The rate constant of the decomposition reaction of acetaldehyde in the presence of each photocatalytic substrate was then determined in accordance with the procedure set forth in Example 1. The result for each of the samples is set forth in Table 2 below.

TABLE 2

Rate constants of acetaldehyde decomposition for Samples 3A-3D.

| Sample | Rate Constant |
|---|---|
| 3A | 0.0024 |
| 3B | 0.0008 |
| 3C | 0.0015 |
| 3D | 0.0056 |

As can be seen from the results set forth in Table 3, the photocatalytic substrates produced using dry, powdered photocatalytic materials which were dispersed or suspended in a medium prior to application (i.e., Samples 3A and 3D) exhibited higher photocatalytic activity that those substrates produced using sols of a photocatalytic material. Sols of a photocatalytic material, such as the titanium dioxide sols used to produce Samples 3B and 3C, generally are very fine dispersions of the particulate photocatalytic material with no or only a minimal amount of agglomerates contained therein. This greater photocatalytic activity is evidenced by the increased rate constant of the acetaldehyde decomposition reaction in the presence of Samples 3A and 3D.

Figure 3:
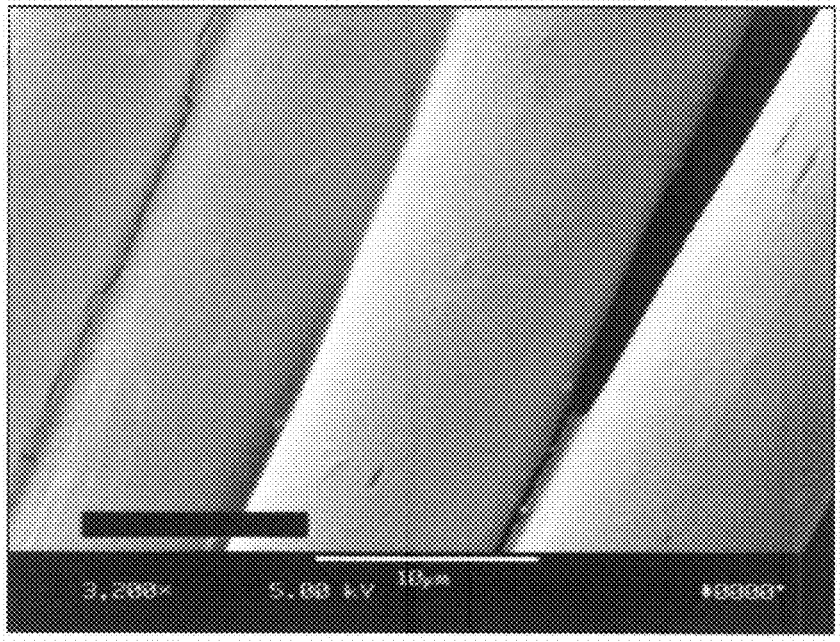
FIG. 3 is a scanning electron micrograph (3,200 times magnification) of a portion of the surface of Sample 3C.
Figure 3A:
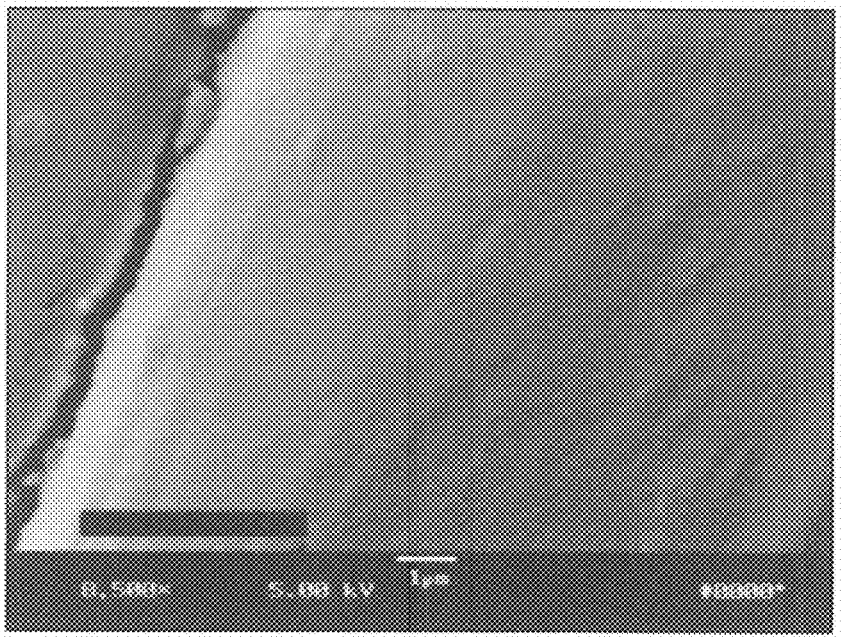
FIG. 3A is a scanning electron micrograph (8,500 times magnification) of a portion of the surface of Sample 3C.

The surface of each sample was then analyzed using scanning electron microscopy to qualitatively analyze the morphology of the finish on the surface of the textile support. The micrographs obtained for each of Samples 3A-3D are set forth in FIGS. 1-4B. As can be seen from a comparison of the micrographs, those substrates exhibiting higher photocatalytic activity (i.e., Samples 3A and 3D) had a finish comprising agglomerates of the photocatalytic material, while those substrates exhibiting a lower photocatalytic activity (i.e., Samples 3B and 3C) had a finish containing photocatalytic material that was relatively uniform in size and did not contain detectable agglomerates.

EXAMPLE 4

This example demonstrates the preparation of several photocatalytic substrates according to the invention and the photocatalytic properties of the same. Eight substrates (Samples 4A-4H) were prepared in accordance with the procedure set forth in Example 1 using varying amounts of the photocatalyst (AEROXIDE P25 from Degussa) and a polyacrylic latex binder (RHOPLEX HA-16 from Rohm and Haas Company). The amounts of photocatalyst and binder used are set forth in Table 3 below. The binder used to produce the samples (i.e., RHOPLEX HA-16) is an aqueous emulsion of the polyacrylic latex binder containing approximately 45% by weight binder solids. The binder amounts set forth in Table 3 below are based on the amount of the emulsion added (i.e., aqueous medium and the binder solids).

The photocatalytic activity of each of the substrates was quantitatively measured in accordance with the procedure set forth in Example 1. The rate constant of the acetaldehyde decomposition reaction in the presence of each of the samples is set forth in Table 3 below.

TABLE 3

Amounts of photocatalyst and binder and rate constants of acetaldehyde decomposition for Samples 4A-4H.

| Sample | Amount of Photocatalyst (g) | Amount of Binder (wt. %) | Rate constant ($min^{-1}$) |
|---|---|---|---|
| 4A | 0.1 | 1.0 | 0.0005 |
| 4B | 0.3 | 1.0 | 0.0010 |
| 4C | 0.6 | 1.0 | 0.0015 |
| 4D | 1.0 | 1.0 | 0.0014 |
| 4E | 0.2 | 0.5 | 0.0007 |
| 4F | 0.4 | 0.5 | 0.0009 |
| 4G | 0.6 | 0.5 | 0.0027 |
| 4H | 1.0 | 0.5 | 0.0036 |

As can be seen from the results set forth in Table 3, the photocatalytic activity of the substrates (as evidenced by the rate constant of the acetaldehyde decomposition reaction) generally increased with greater amounts of photocatalyst. However, a comparison of Samples 4C, 4D, 4G, and 4H showed that, for the same photocatalyst concentration, the photocatalytic activity actually increased for those substrates having less binder.

EXAMPLE 5

This example demonstrates the preparation of several photocatalytic substrates according to the invention and the photocatalytic properties of the same. Five samples (Samples 5A-5E) were prepared by treating five different textile materials in accordance with the procedure set forth in Example 1. Sample 5A was made with a coffee-colored, woven twill, texture polyester fabric. Sample 5B was made with a gray, pole knit, polyester pile fabric. Sample 5C was made with an undyed, white, circular knit polyester fabric. Sample 5D was made with a disperse dyed, red, circular knit polyester fabric. Sample 5E was made with a disperse dyed, black, circular knit polyester fabric.

Each sample was then tested to determine its average light reflectance and average absorbance of light having a wavelength between 400 nm and 250 nm. The substrates were also tested in accordance the procedure set forth in Example 1 to determine their photocatalytic activity. In order to determine the lighffastness of the substrates, Samples 5A and 5B were also tested in accordance with SAE Test Method J1885 by exposing the samples to approximately 225 kJ of ultraviolet radiation. The color change of the substrate was then measured using a photometer and expressed in terms of ΔE. The results of these measurements are set forth in Table 4 below.

TABLE 4

Average light reflectance, average light absorbance, and ΔE for Samples 5A-5E.

| Sample | Average Light Reflectance (%) | Average Light Absorbance | Rate Constant ($min^{-1}$) | ΔE |
|---|---|---|---|---|
| 5A | 4.5 | 3.16 | 0.0014 | 4.1 |
| 5B | 11.3 | 1.96 | 0.0008 | 2.78 |
| 5C | 55.2 | 0.79 | 0.0011 | — |
| 5D | 10.9 | 1.63 | 0.0007 | — |
| 5E | 5.15 | 1.62 | 0.0005 | — |

As can be seen from the results, the photocatalytic substrates of the invention show photocatalytic activity with a variety of different color textile supports. The results also demonstrate that the photocatalytic activity of the substrate (as determined by a comparison of the rate constant of the acetaldehyde decomposition reaction) is generally lower for darker colored substrates than lighter color substrates. For example, a comparison of the rate constants measured for Samples 5C-5E showed that the photocatalytic activity of the substrates was highest for the white substrate and lowest for the black substrate. While not wishing to be bound to any particular theory, it is believed that this observed decrease in the photocatalytic activity based on the substrate color may be attributable, at least in part, to competitive absorption of ultraviolet light by the dark-colored dye or pigment. Thus, it is believed that, as the amount of ultraviolet light absorbed by the dye or pigment increases, there is less ultraviolet light available for the photocatalyst to utilize to catalyze the reaction. The foregoing results also show that the photocatalytic finish applied to the textile support does not significantly affect the color of the support, even after exposure to large amounts of ultraviolet radiation.

EXAMPLE 6

This example demonstrates the preparation of several photocatalytic substrates according to the invention and the photocatalytic properties of the same. Four samples (Samples 6A-6D) were produced in accordance with the general procedure set forth in Example 1, with the following modifications. The coating composition used to produce Samples 6A and 6B did not contain a dispersant, and the coating composition used to produce Samples 6C and 6D contained 0.1 wt % of a phosphate ester surfactant (RHODOFAC RS-610 from Rhodia, Inc.). The coating composition used to produce Samples 6A and 6C contained 1 wt. % of a polyacrylic latex binder (RHOPLEX E-32NP from Rohm and Haas Company), and the coating composition used to produce Samples 6B and 6D contained 1 wt. % of a different polyacrylic latex binder (RHOPLEX HA-16 from Rohm and Haas Company). The samples were then tested in accordance with the procedure set forth in Example 1 to determine the rate constant of the acetaldehyde decomposition reaction in the presence of each sample. The results of these measurements are set forth in Table 5 below.

TABLE 5

Rate constants for the acetaldehyde decomposition reaction for Samples 6A-6D.

| Sample | Dispersant | Binder | Rate Constant ($min^{-1}$) |
|---|---|---|---|
| 6A | — | 1 wt. % E-32NP | 0.0011 |
| 6B | — | 1 wt. % HA-16 | 0.0014 |
| 6C | 0.1 wt. % | 1 wt. % E-32NP | 0.0018 |
| 6D | 0.1 wt. % | 1 wt. % HA-16 | 0.0021 |

As can be seen from the foregoing results, the presence of a dispersant (e.g., phosphate ester surfactant) in the coating composition can increase the photocatalytic activity of the substrate produced using the coating composition.

COMPARATIVE EXAMPLE

This example demonstrates the effects of depositing a photocatalyst onto the surface of a textile material without the use of a binder. A swatch of woven, polyester fabric measuring approximately 30 cm (12 inches) by approximately 30 cm (12 inches) was placed in a small laboratory jet dyeing machine. Approximately 1 liter of an aqueous dispersion comprising deionized water, approximately 0.1 wt. % of fumed, anatase-rich titanium dioxide (AEROXIDE P25 from Degussa), and several drops of hydrochloric acid was then placed into the jet dyeing machine. The fabric was then agitated in the aqueous dispersion for approximately 30 minutes at a temperature of approximately 125° C. and an elevated pressure. The fabric was allowed to cool, gently rinsed with water, and dried. The resulting fabric had an adsorbed layer of titanium dioxide on the surface thereof.

The fabric was then subjected to accelerated ultraviolet light exposure in accordance with SAE Test Method J1885 for a total ultraviolet radiation exposure of approximately 225 kJ. After irradiation, the fabric was dramatically weakened and was easily torn by hand. A scanning electron micrograph of the surface of the fabric revealed significant pitting and etching of the fabric's fibers. By way of contrast, substrates prepared in accordance with the procedure set forth in Example 2 did not show any visible surface damage after similar ultraviolet exposure. Also, the color of the substrates prepared in accordance with the procedure set forth in Example 2 did not show significant color change after the ultraviolet exposure.

EXAMPLE 7

This example demonstrates the preparation of several photocatalytic substrates according to the invention and the photocatalytic properties of the same. Four samples (Samples 7A-7D) were produced in accordance with the general procedure set forth in Example 1, with the following modifications. Samples 7A and 7C were white, plain woven, 100% spun yarn, polyester fabrics. Samples 7B and 7D were black, plain woven, 100% spun yarn polyester fabrics. The coating compositions used to produce the substrates comprised approximately 1 wt. % of a fumed, anatase-rich titanium dioxide (AEROXIDE P25 from Degussa). The coating composition used to produce Sample 7A and 7B also contained approximately 1 wt. % of a polyacrylic latex binder (RHOPLEX HA-16 from Rohm and Haas Company). The coating composition used to produce Samples 7C and 7D contained approximately 1 wt. % of a perfluorocarbon-modified monomer (UNIDYNE TG-5010 from Daikin Industries, Ltd.) and approximately 0.5 wt. % of a methylethyl ketoxime blocked aliphatic isocyanate trimer crosslinking agent (ARKOPHOB DAN from Clariant).

The resulting substrates were tested in accordance with the procedure set forth in Example 1 to quantitatively determine their photocatalytic activity. The results of these measurements are set forth in Table 6 below. The samples were then exposed to ultraviolet radiation for approximately 40 hours in accordance with AATCC Test Method 16, Option E, and the photocatalytic activity of the samples was again quantitatively measured in accordance with the procedure set forth in Example 1. The results of these measurements are also set forth in Table 6 below.

TABLE 6

Rate constants for the acetaldehyde decomposition reaction for Samples 6A-6D.

| Sample | Initial Rate Constant ($min^{-1}$) | Irradiated Rate Constant ($min^{-1}$) |
|---|---|---|
| 7A | 0.0015 | 0.0046 |
| 7B | 0.0009 | 0.0017 |
| 7C | 0.0010 | 0.0046 |
| 7D | 0.0009 | 0.0019 |

As can be seen from the foregoing results, the photocatalytic activity of each of the samples (as determined by a comparison of the rate constant of the acetaldehyde decomposition reaction) increased by approximately 88% to approximately 360% after the substrates had been exposed to ultraviolet radiation as described above. While not wishing to be bound to any particular theory, it is believed that the observed increase in the photocatalytic activity of the substrates can be attributed, at least in part, to the partial degradation of the binder due to the ultraviolet radiation and the photocatalyst. It is believed that this partial degradation of the binder helps to expose a greater amount of the photocatalytic material's surface area, thereby increasing the area available for catalysis and increasing the rate of the reaction. The irradiated samples were then washed several times in an effort to determine if the believed partial degradation of the binder adversely affected the adhesion of the photocatalytic material to the textile support. After select samples were subjected to several washes, the photocatalytic activity of the washed and unwashed samples was determined in accordance with the procedure set forth in Example 1. A comparison of the photocatalytic activity of the washed and unwashed samples revealed little change in activity between washed and unwashed samples. Thus, while not wishing to be bound to any particular theory, it is believed that the theorized partial degradation of the binder does not adversely affect, as a whole, the adhesion of the-particulate photocatalytic material to the textile support.

EXAMPLE 8

This example demonstrates the preparation of a photocatalytic substrate according to the invention, the photocatalytic properties of the same, and the durability of the substrate to laundering. A swatch of white, woven, 100% polyester fabric was treated in accordance with the general procedure set forth in Example 1 using a coating composition containing the following: approximately 1 wt. % of a fumed, anatase-rich titanium dioxide (AEROXIDE P25 from Degussa), approximately 0.2 wt. % of ammonium hydroxide, approximately 1 wt. % of an polyacrylic latex binder (RHOPLEX HA-16 from Rohm and Haas Company), and the balance water.

The resulting substrate was tested in accordance with the procedure set forth in Example 1 to quantitatively determine its photocatalytic activity. The results of this measurement are set forth in Table 7 below. The substrate was then run through ten household laundering cycles (i.e., a wash cycle in a household washing machine and a drying cycle in a household tumble dryer), and the photocatalytic activity of the sample was again quantitatively measured in accordance with the procedure set forth in Example 1. The results of this measurement are also set forth in Table 7 below.

TABLE 7

Rate constants for the acetaldehyde decomposition reaction for Samples 6A-6D.

| Number of Home Launderings (cycles) | Rate Constant ($min^{-1}$) |
|---|---|
| 0 | 0.0015 |
| 10 | 0.0012 |

As can be seen from the foregoing results, a photocatalytic substrate according to the invention is relatively durable, as evidenced by the relatively small decrease in photocatalytic activity exhibited by the substrate after ten home laundering cycles. In particular, the photocatalytic activity of the substrate (as determined by a comparison of the rate constant of the acetaldehyde decomposition reaction) decreased by only 20% after the substrate had been run through ten home laundering cycles.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A process for producing a photocatalytic substrate, the process comprising the steps of:

(a) providing a textile support having at least one surface, (b) providing a coating composition, the coating composition being prepared by the steps, in order:

(i) providing a liquid medium, (ii) dispersing a dry, particulate anatase titanium dioxide comprising individual primary particles in the liquid medium, wherein dispersing the primary particles of anatase titanium dioxide in the liquid medium forms agglomerated anatase titanium dioxide having an average agglomerate size of between about 0.2 and 14 microns, and (iii) adding a binder to the liquid medium produced in step (ii) to produce a coating composition, wherein the binder comprises polyacrylic latex, wherein the polyacrylic latex comprises a polyacrylic latex polymer backbone comprising 20% or less, by number, Si—O bonds, the coating composition comprising about 0.2 to about 1 wt. %, based on the total weight thereof, of the anatase titanium dioxide and an amount of binder sufficient to provide a ratio, by weight, of anatase titanium dioxide to binder of about 1:0.1 to about 1:5, (c) applying the coating composition to at least a portion of the surface of the textile support, and (d) drying the surface of the textile support to which the coating composition was applied to produce a photocatalytic substrate.

2. The process of claim 1, wherein the textile support comprises polyester-containing yams, and the yarns are provided in a woven or knit construction.

3. The process of claim 1, wherein the anatase titanium dioxide is present on the surface of the support in an amount of about 0.5 to about 1 wt. % based on the total weight of the substrate.

4. The process of claim 1, wherein the coating composition further comprises a dispersant selected from the group consisting of phosphate esters, ammonia, ammonium hydroxide, and combinations thereof.

5. The process of claim 4, wherein the dispersant is added to the liquid medium prior to the addition of the binder.

6. The process of claim 1, wherein the agglomerated anatase titanium dioxide having an average agglomerate size of between about 1 and 6 microns.

7. The process of claim 1, wherein the photocatalytic substrate is wash durable defined as a decrease of less than 20% of the rate constant of an acetaldehyde decomposition reaction after 10 home laundering cycles.

8. A process for producing a photocatalytic substrate, the process comprising the steps of:

(a) providing a textile support having at least one surface, (b) providing a coating composition, the coating composition being prepared by the steps, in order:

(i) providing a liquid medium, (ii) dispersing a dry, particulate anatase titanium dioxide comprising individual primary particles in the liquid medium, wherein dispersing the primary particles of anatase titanium dioxide in the liquid medium forms agglomerated anatase titanium dioxide having an average agglomerate size of between about 0.2 and 14 microns;

(iii) adding a phosphate ester dispersant; and, (iv) adding a binder to the liquid medium produced in step (ii) to produce a coating composition, wherein the binder comprises polyacrylic latex, wherein the polyacrylic latex comprises a polyacrylic latex polymer backbone comprising 20% or less, by number, Si—O bonds, the coating composition comprising about 0.2 to about 1 wt %, based on the total weight thereof, of the anatase titanium dioxide and an amount of binder sufficient to provide a ratio, by weight, of anatase titanium dioxide to binder of about 1:0.1 to about 1:5, (c) applying the coating composition to at least a portion of the surface of the textile support, and (d) drying the surface of the textile support to which the coating composition was applied to produce a photocatalytic substrate.

* * * * *

UNITED STATES PATENT AND TRADEMARK OFFICE

CERTIFICATE OF CORRECTION

PATENT NO. : 7,592,048 B2
APPLICATION NO. : 11/983274
DATED : September 22, 2009
INVENTOR(S) : Li et al.

It is certified that error appears in the above-identified patent and that said Letters Patent is hereby corrected as shown below:

In column 15, line 39, the word "yams" should be "yarn"

Signed and Sealed this

Eighth Day of December, 2009

David J. Kappos

David J. Kappos
*Director of the United States Patent and Trademark Office*